US010679549B2

(12) United States Patent
Yu et al.

(10) Patent No.: US 10,679,549 B2
(45) Date of Patent: Jun. 9, 2020

(54) LIGHT EMISSION CONTROL DRIVER

(71) Applicant: LG DISPLAY CO., LTD., Seoul (KR)

(72) Inventors: JaeSung Yu, Paju-si (KR); Jinhee Heo, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/223,759

(22) Filed: Dec. 18, 2018

(65) Prior Publication Data

US 2019/0206311 A1 Jul. 4, 2019

(30) Foreign Application Priority Data

Dec. 28, 2017 (KR) ..... 10-2017-0183067

(51) Int. Cl.
*G09G 3/3208* (2016.01)
*G09G 3/20* (2006.01)

(52) U.S. Cl.
CPC ..... *G09G 3/3208* (2013.01); *G09G 3/20* (2013.01); *G09G 2320/064* (2013.01)

(58) Field of Classification Search
CPC .. G09G 3/3208; G09G 3/3266; G09G 3/3674; G09G 3/3696
See application file for complete search history.

(56) References Cited

U.S. PATENT DOCUMENTS 9,881,689 B2 * 1/2018 Lee ..... G11C 19/28
2008/0055207 A1 * 3/2008 Chung ..... G09G 3/3225 345/76
2008/0157684 A1 * 7/2008 Chung ..... G09G 3/3266 315/169.3
2011/0057864 A1 * 3/2011 Chung ..... G09G 3/3266 345/76
2011/0273418 A1 * 11/2011 Park ..... G09G 3/3208 345/211
2016/0379558 A1 * 12/2016 Jeon ..... G09G 3/3225 345/213
2017/0345366 A1 * 11/2017 Jang ..... G09G 3/3266

* cited by examiner

*Primary Examiner* — Kevin M Nguyen
(74) *Attorney, Agent, or Firm* — Polsinelli PC

(57) ABSTRACT

Provided herein is a light emission control driver according to an aspect of the present disclosure. The light emission control driver includes a plurality of stages, wherein each of the plurality of stages has a first circuit part configured to receive a first start signal and a second start signal and control a first node and a second node in response to a first clock signal, a third circuit part configured to output a second light emission control signal in response to a first control signal applied to the first node or a second control signal applied to the second node, and an output part configured to output a first light emission control signal in response to the first control signal or the second light emission control signal.

19 Claims, 6 Drawing Sheets

LIGHT EMISSION CONTROL DRIVER

CROSS-REFERENCE TO RELATED APPLICATION

This application claims priority to Korean Patent Application No. 10-2017-0183067, filed on Dec. 28, 2017, the disclosure of which is incorporated herein by reference in its entirety.

BACKGROUND

Field of the Disclosure

The present disclosure relates to a light emission control driver capable of being decreased in area and reducing a ripple phenomenon of an output signal.

Description of the Background

Generally, an organic light emitting display device includes a display panel and a driver. The display panel includes a plurality of scan lines, a plurality of data lines, a plurality of light emission control lines, and a plurality of pixels. The driver includes a scan driver configured to provide scan signals to the plurality of scan lines, a light emission control driver configured to provide light emission control signals to the plurality of light emission control lines, and a data driver configured to provide data signals to the plurality of data lines. The light emission control driver includes a plurality of stages outputting the light emission control signals. Each of the stages includes a plurality of transistors and a capacitor.

Recently, research has been conducted to reduce a size of a bezel of an organic light emitting display device and to improve stability of a circuit. However, when the size of the bezel is reduced, the stability of the circuit is lowered, and when the stability of the circuit is increased, a size of an element becomes larger and a layout thereof becomes complicated, and thus there is a problem in that the size of the bezel can be increased.

SUMMARY

The present disclosure is to provide a light emission control driver capable of reducing a ripple phenomenon and implementing a circuit with an improved operating margin.

In addition, the present disclosure is to provide a light emission control driver capable of simplifying a circuit using two light emission control signals of one stage as start signals of a next stage to reduce a gate-driver in panel (GIP) area.

Provided herein is a light emission control driver according to an aspect of the present disclosure. In accordance with one aspect of the present disclosure, a light emission control driver includes a plurality of stages, wherein each of the plurality of stages has a first circuit part configured to receive a first start signal and a second start signal and control a first node and a second node in response to a first clock signal, a third circuit part configured to output a second light emission control signal in response to a first control signal applied to the first node or a second control signal applied to the second node, and an output part configured to output a first light emission control signal in response to the first control signal or the second light emission control signal.

According to an example, the first light emission control signal and the second light emission control signal may be a first start signal and a second start signal of a next stage.

According to an example, the first circuit part may include a first transistor to which the first start signal is applied, and a second transistor to which the second start signal is applied, wherein the first clock signal may be applied to a gate electrode of the first transistor and a gate electrode of the second transistor.

According to an example, the driver may further include a second circuit part configured to receive a second clock signal and configured to be switched by the first control signal and the second control signal to stabilize signals at the first node and the second node.

According to an example, the second circuit part may include a third transistor having a gate electrode connected to the first node, an input terminal for receiving the second clock signal, and an output terminal connected to a first capacitor, and a fourth transistor having a gate electrode connected to the second node, an input terminal for receiving the second clock signal, and an output terminal connected to a second capacitor, wherein the first capacitor may be disposed between the first node and the output terminal of the third transistor, and the second capacitor may be disposed between the second node and the output terminal of the fourth transistor.

According to an example, the third circuit part may include a fifth transistor configured to be switched on the basis of the first control signal applied to the first node, and a sixth transistor configured to be switched on the basis of the second control signal applied to the second node, wherein a first voltage may be applied to an input terminal of the fifth transistor and a second voltage may be applied to an input terminal of the sixth transistor.

According to an example, when a voltage of the first node is a low level voltage, the fifth transistor may be turned on to output the first voltage as the second light emission control signal.

According to an example, when a voltage of the second node is a low level voltage, the sixth transistor may be turned on to output the second voltage as the second light emission control signal.

According to an example, a signal applied to a third node at which the output terminal of the fifth transistor and the output terminal of the sixth transistor are connected may be the second light emission control signal.

According to an example, a third capacitor for boosting a voltage of the second node may be disposed between the third node and the second node.

According to an example, the output part may include a first output transistor configured to output a second voltage as the first light emission control signal in response to the first control signal, and a second output transistor configured to output a first voltage as the first light emission control signal in response to the second light emission control signal, wherein an output terminal of the first output transistor and an output terminal of the second output transistor may be connected at a first output terminal from which the first light emission control signal is output.

According to an example, the second light emission control signal may be applied to a gate electrode of the second output transistor to control a switching of the second output transistor.

According to an example, when a voltage of the first node is a low level voltage, the first output transistor may be turned on to output the second voltage as the first light emission control signal.

According to an example, when the voltage of the first node is a high level voltage and the voltage of the second node is a low level voltage, the second output transistor may be turned on to output the first voltage as the first light emission control signal.

According to an example, a fourth capacitor for boosting the voltage of the second node may be disposed between a gate terminal of the second output transistor and an input terminal thereof.

According to an example, a fifth capacitor for boosting the voltage of the first node may be disposed between the first output terminal and a gate electrode of the first output transistor.

According to an example, the first clock signal applied to one of the plurality of stages may be an inverted signal of a first clock signal applied to a next stage of the one stage.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
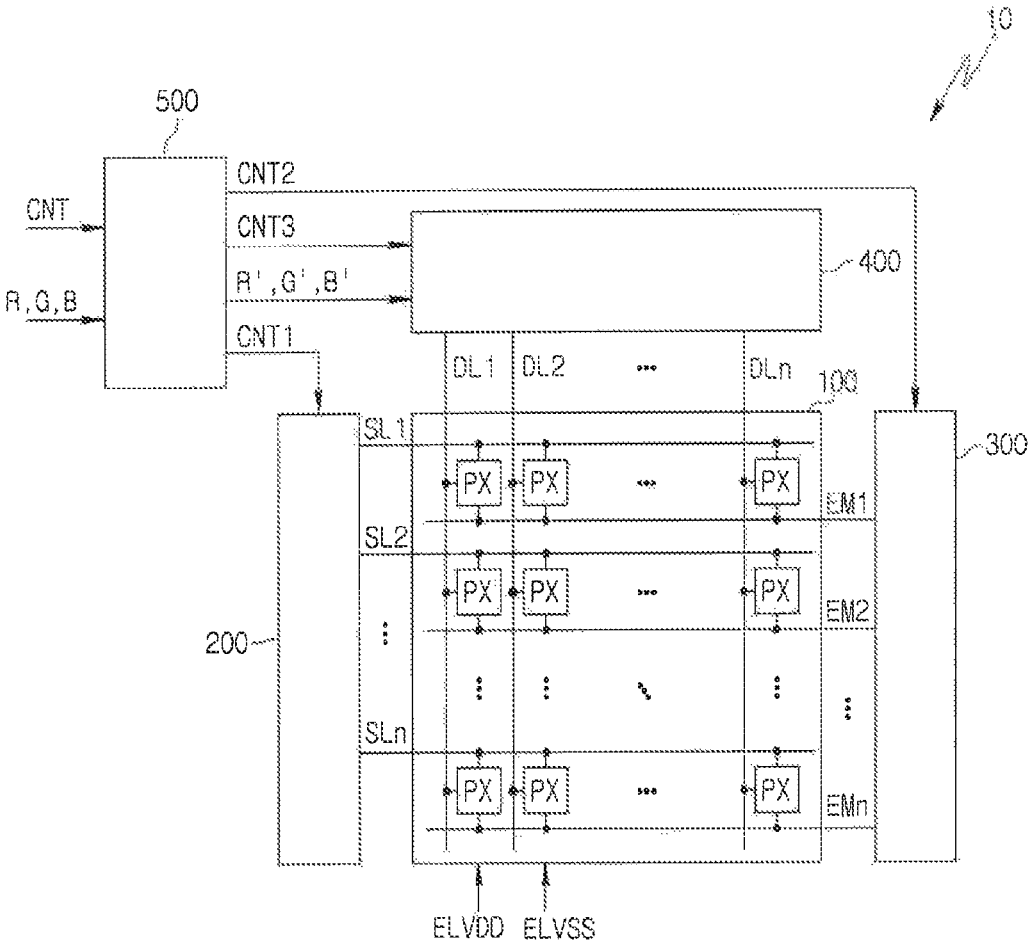
FIG. 1 is a block diagram of a display device according to an aspect of the present disclosure.

The advantages and features of the present disclosure and a manner for achieving them will become apparent with reference to the aspects described in detail below together with the accompanying drawings. The present disclosure may, however, be implemented in many different forms and should not be construed as being limited to the aspects set forth herein, and the aspects are provided such that this disclosure will be thorough and complete and will fully convey the scope of the present disclosure to those skilled in the art, and the present disclosure is defined by only the scope of the appended claims. Like reference numerals refer to like elements throughout the specification.

Further, the aspects described herein will be described with reference to cross-sectional views and/or plan views, which are ideal exemplary diagrams of the present disclosure. In the drawings, thicknesses of films and area are exaggerated to effectively describe the technical contents. Therefore, the shape of an exemplary diagram may be modified by manufacturing techniques and/or tolerances. Accordingly, the aspects of the present disclosure are not limited to specific shapes shown in the drawings, and include alternations in shape that is produced according to the manufacturing process. For example, etching areas shown in the drawings at a right angle may be rounded or may have a shape with a predetermined curvature. Thus, illustrative regions in the drawings have schematic attributes, and the shapes of the illustrative regions in the drawings are intended to illustrate specific shapes of regions of devices and not intended to limit the scope of the present disclosure.

FIG. 1 is a block diagram of a display device according to an aspect of the present disclosure.

Referring to FIG. 1, a display device 10 may include a display panel 100, a scan driver 200, a light emission control driver 300, a data driver 400, and a controller 500.

The display panel 100 may display an image. The display panel 100 may include a plurality of scan lines SL1 to SLn, a plurality of data lines DL1 to DLn, a plurality of light emission control lines EM1 to EMn, and a plurality of pixels PX. For example, the display panel 100 may include n*m number of pixels PX positioned at intersections between the plurality of scan lines SL1 to SLn and the plurality of data lines DL1 to DLn.

The scan driver 200 may provide scan signals to the plurality of pixels PX through the plurality of scan lines SL1 to SLn.

The light emission control driver 300 may provide light emission control signals to the plurality of pixels PX through the plurality of light emission control lines EM1 to EMn. The light emission control driver 300 may include a plurality of stages outputting the light emission control signals. The light emission control driver 300 may be directly formed on the display panel 100 according to a gate-driver in panel (GIP) method.

The data driver 400 may receive a third control signal CNT3 and output image data R', G', and B' from controller 500. The data driver 400 may convert the output image data R', G', and B' into analog data signals on the basis of the third control signal CNT3 and provides the analog data signals to the plurality of pixels PX through the plurality of data lines DL1 to DLn.

The controller 500 may control the scan driver 200, the light emission control driver 300, and the data driver 400. The controller 500 may receive input image data R, G, and B and a control signal CNT from the outside (e.g., a system board). The controller 500 may generate first, second, and third control signals CNT1, CNT2, and CNT3 to control the scan driver 200, the light emission control driver 300, and the data driver 400. For example, each of the first control signal CNT1 and the second control signal CNT2 for controlling the scan driver 200 may include a vertical start signal, a scan clock signal, and the like. The third control signal CNT3 for controlling the data driver 400 may include a horizontal start signal, a load signal, and the like. The controller 500 may generate the digital output data R', G', and B' according to an operation condition of the display panel 100 on the basis of the input image data R, G and B and provide the digital output data R', G', and B' to the data driver 400.

Figure 2:
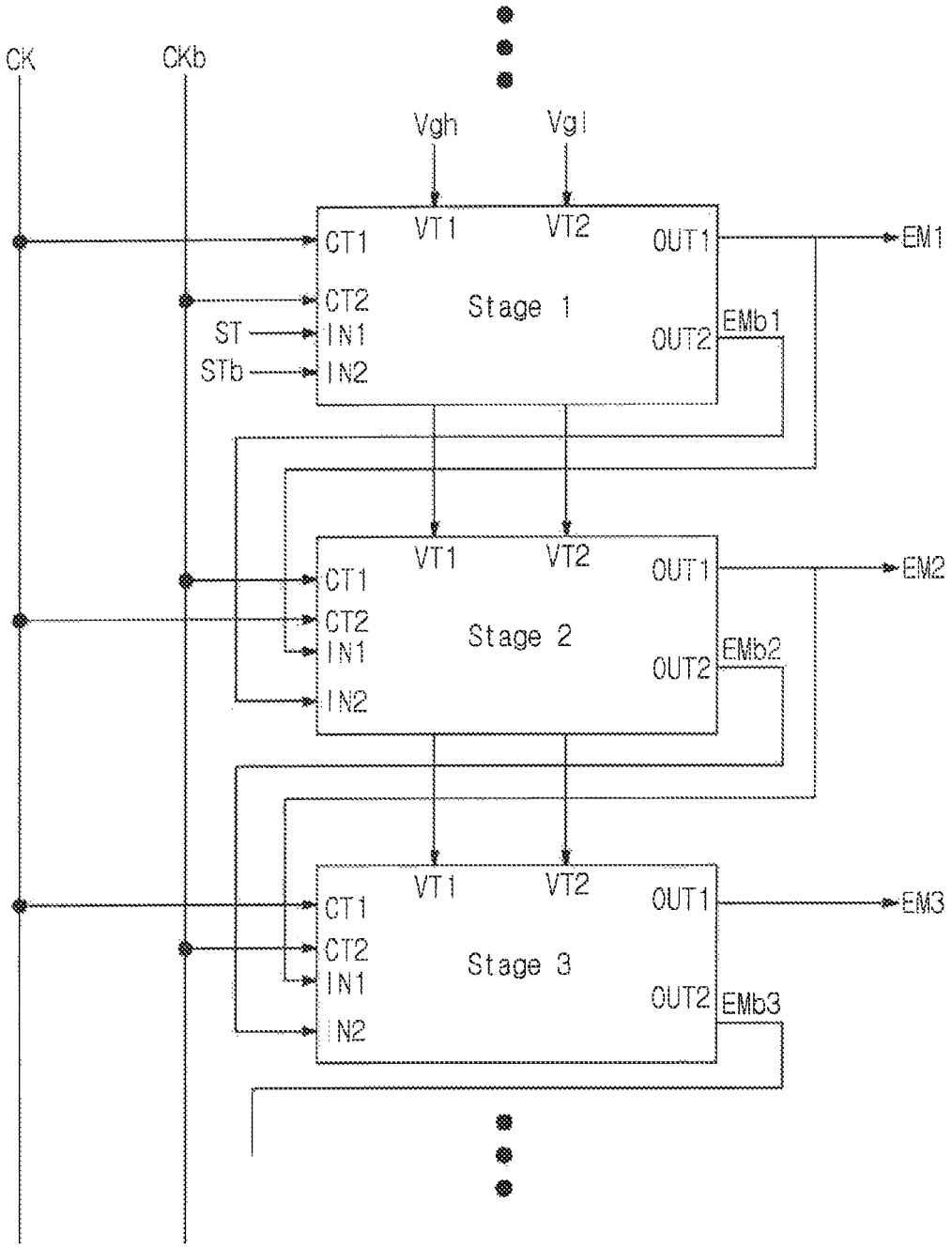
FIG. 2 is a block diagram of a light emission control driver according to one aspect of the present disclosure.

FIG. 2 is a block diagram of a light emission control driver according to one aspect of the present disclosure.

Referring to FIG. 2, the light emission control driver 300 may include a plurality of stages, that is, Stage 1, Stage 2, and Stage 3. Each of Stage 1, Stage 2, and Stage 3 may output a light emission control signal. Each of Stage 1, Stage 2, and Stage 3 may include a first input terminal IN1, a second input terminal IN2, a first clock terminal CT1, a second clock terminal CT2, a first voltage terminal VT1, a second voltage terminal VT2, a first output terminal OUT1, and a second output terminal OUT2.

A first clock signal CK and a second clock signal CKb, which have different timings, may be applied to the first clock terminal CT1 and the second clock terminal CT2 of each of Stage 1, Stage 2, and Stage 3. For example, the second clock signal CKb may be an inverted signal of the first clock signal CK. The first clock signal CK and the second clock signal CKb may be applied in reverse to adjacent stages. For example, the first clock signal CK may be applied to the first clock terminal CT1 of an odd-numbered stage (e.g., Stage 1) as a clock signal, and the second clock signal CKb may be applied to the second clock terminal CT2 as a clock signal. Contrarily, the second clock signal CKb may be applied to the first clock terminal CT1 of an even-numbered stage (e.g., Stage 2) as a clock signal, and the first clock signal CK may be applied to the second clock terminal CT2 as a clock signal. A start signal or a light stage emission control signal of a previous stage may be applied to the first and second input terminals IN1 and IN2 of each of Stage 1, Stage 2, and Stage 3. That is, the start signal may be applied to first and second input terminals IN1 and IN2 of a first stage among Stage 1, Stage 2, and Stage 3, and a light stage emission control signal of a previous stage may be applied to first and second input terminals IN1 and IN2 of each of the remaining stages thereamong as a start signal. First and second emission control signals (e.g., EM1 and EMb1) of the previous stage may be first and second start signals st and stb of a next stage. The first and second output terminals OUT1 and OUT2 of each of Stage 1, Stage 2, and Stage 3 may output emission control signals to emission control lines.

A first voltage Vgh may be provided to the first voltage terminal VT1 of each of Stage 1, Stage 2, and Stage 3. For example, the first voltage Vgh may be a high level voltage. A second voltage Vgl may be provided to the second voltage terminal VT2 of each of Stage 1, Stage 2, and Stage 3. For example, the second voltage Vgl may be a low level voltage.

Figure 3:
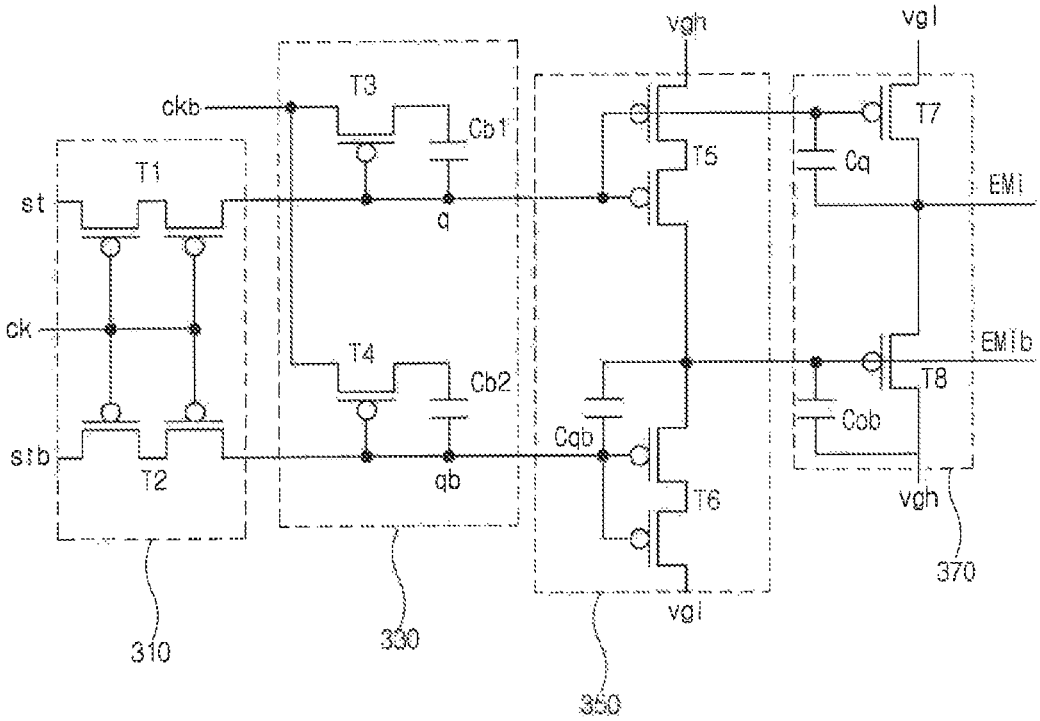
FIG. 3 is a circuit diagram of one stage of the light emission control driver according to one aspect of the present disclosure.

FIG. 3 is a circuit diagram of one stage of the light emission control driver according to one aspect of the present disclosure.

Referring to FIGS. 2 and 3, stages of the light emission control driver 300 may include a first circuit part 310, a second circuit part 330, a third circuit part 350, and an output part 370. Transistors constituting each of the first circuit part 310, the second circuit part 330, the third circuit part 350, and the output part 370 may be P-type metal oxide semiconductor (PMOS) transistors, but the present disclosure is not limited thereto. A region to which a first start signal st is applied may be a region for outputting a first light emission control signal Emi and be defined as a first output terminal, and a region to which a second start signal stb is applied may be a region for outputting a second light emission control signal EMi and be defined as a second output terminal.

The first circuit part 310 may control a first node q and a second node qb in response to the first start signal st, the second start signal stb, and the first clock signal CK. The first circuit part 310 may include a first transistor T1 configured to apply the first start signal st to the first node q by being switched by the first clock signal CK, and a second transistor T2 configured to apply the second start signal stb to the second node qb by being switched by the first clock signal CK. The first clock signal CK may be applied to a gate electrode of each of the first transistor T1 and the second transistor T2. The first start signal st transmitted to the first node q by the first transistor T1 may be defined as a first control signal, and the second start signal stb transmitted to the second node qb by the second transistor T2 may be defined as a second control signal. An input terminal of the first transistor T1 may be connected to the first input terminal IN1 to which the first start signal st is applied, and an output terminal of the first transistor T1 may be connected to the first node q. An input terminal of the second transistor T2 may be connected to the second input terminal IN2 to which the second start signal stb is applied, and an output terminal of the second transistor T2 may be connected to the second node qb. Each of the first transistor T1 and the second transistor T2 may have a structure in which two transistors are connected in series so as to reduce a load of a transistor.

The second circuit part 330 may receive the second start signal stb and may be switched by the first control signal and the second control signal to stabilize the first node q and the second node qb. The second circuit part 330 may include a third transistor T3 having a gate electrode connected to the first node q, an input terminal for receiving the second clock signal CKb, and an output terminal connected to a first capacitor Cb1, and a fourth transistor T4 having a gate electrode connected to the second node qb, an input terminal for receiving the second start signal stb, and an output terminal coupled to a second capacitor Cb2. The first capacitor Cb1 may be disposed between the output terminal of the third transistor T3 and the first node q, and the second capacitor Cb2 may be disposed between the output terminal of the fourth transistor T4 and the second node qb. The second circuit part 330 may stabilize the first control signal and the second control signal, which are applied to the first node q and the second node qb, by the first circuit part 310. Generally, the first start signal st and the second start signal stb are varied in voltage by a threshold voltage of each of the first transistor T1 and the second transistor T2 and are applied to the first node q and the second node qb. Accordingly, a low level voltage of each of the first start signal st and the second start signal stb may not be directly applied to the first node q and the second node qb. According to the aspect of the present disclosure, when a voltage of the first node q is a low level voltage, a second clock signal CKb of a low level may be applied to the third transistor T3 to charge the first capacitor Cb1 with a low level voltage. The low level voltage stored in the first capacitor Cb1 may prevent the low level voltage of the first node q from rising to the threshold voltage of the first transistor T1. Further, when a voltage of the second node qb is a low level voltage, a second clock signal CKb of a low level may be applied to the fourth transistor T4 to charge the second capacitor Cb2 with a low level voltage. The low level voltage stored in the second capacitor Cb2 may prevent a voltage of the second node qb from rising to the threshold voltage of the second transistor T2. Accordingly, it is possible to implement a circuit which is less affected by the threshold voltages of the first transistor T1 and the second transistor T2, so that an operating margin of the light emission control driver 300 can be improved. In this case, since the first clock signal CK is an inverted signal of the second clock signal CKb, each of the first transistor T1 and the second transistor T2 may be in a turn-off state.

The third circuit part 350 may generate the second light emission control signal EMib in response to the first control signal of the first node q and the second control signal of the second node qb. The third circuit part 350 may include a fifth transistor T5 configured to be switched by the first control signal applied to the first node q, and a sixth transistor T6 configured to be switched by the second control signal applied to the second node qb.

A gate electrode of the fifth transistor T5 may be connected to the first node q, the first voltage Vgh may be applied to an input terminal of the fifth transistor T5, and an output terminal of the fifth transistor T5 may be connected to an output terminal of the sixth transistor T6. The first voltage Vgh may be a high level voltage. The first control signal applied to the first node q may be applied to the gate electrode of the fifth transistor T5. Further, the first control signal applied to the first node q may be applied to a gate electrode of a first output transistor 17 which will be described below. At this point, the fifth transistor T5 may have a structure in which two transistors are connected in series so as to reduce a load of a transistor. When a voltage of the first node q is a low level voltage, the fifth transistor T5 may be turned on to output the first voltage Vgh as the first light emission control signal Emi. At this point, the second light emission control signal EMib may be a signal for switching a second output transistor T8 which will be described below.

A gate electrode of the sixth transistor T6 may be connected to the second node qb, the second voltage Vgl may be applied to an input terminal of the sixth transistor T6, and an output terminal of the sixth transistor T6 may be connected to the output terminal of the fifth transistor T5. The second voltage Vgl may be a low level voltage. At this point, the sixth transistor T6 may have a structure in which two transistors are connected in series so as to reduce a load of a transistor. When a voltage of the second node qb is a low level voltage, the sixth transistor T6 may be turned on to output the second voltage Vgl as the second light emission control signal EMib.

A position at which the fifth transistor T5 and the sixth transistor T6 are connected may be the third node, and the third node may be the second output terminal OUT2. Since the third node is connected to a gate electrode of the second output transistor T8, which will be described below, the second light emission control signal EMib may be applied to the gate electrode of the second output transistor T8. A third capacitor Cqb for boosting the second control signal applied to the second node qb may be disposed between the third node and the second node qb.

The output part 370 may include the first output transistor T7 configured to receive the first control signal from the first node q, and the second output transistor T8 configured to receive the second light emission control signal EMib generated by the third circuit part 350.

The gate electrode of the first output transistor 17 may be connected to the first node q. The second voltage Vgl may be applied to an input terminal of the first output transistor 17, and an output terminal of the first output transistor T7 may be connected to an output terminal of the second output transistor T8. A position at which the output terminal of the first output transistor T7 and the output terminal of the second output transistor T8 are connected may be the first output terminal OUT1. When a voltage of the first node q is a low level voltage, the first output transistor T7 may output the second voltage Vgl as the first light emission control signal Emi through the first output terminal OUT1 in response to the first control signal.

A fifth capacitor Cq may be disposed between the gate electrode of the first output transistor 17 and the first output terminal OUT1. The fifth capacitor Cq may be connected to the first node q to induce a bootstrap of the first node q. Here, the bootstrap is a phenomenon in which the voltage of the first node q rises to a voltage sufficient to turn on the first output transistor T7 due to coupling through parasitic capacitance between a gate and a drain of the first output transistor T7. That is, the fifth capacitor Cq may boost the voltage of the first node q.

A gate electrode of the second output transistor T8 may be connected to the third node which is a position at which the output terminal of the fifth transistor T5 and the output terminal of the sixth transistor T6 are connected. The first voltage Vgh may be applied to the input terminal of the second output transistor T8, and the output terminal of the second output transistor T8 may be connected to the output terminal of the first output transistor 17 and the first output terminal OUT1. When the second node qb has a low level voltage, the sixth transistor T6 may be turned on and thus the second voltage Vgl may be applied to the gate electrode of the second output transistor T8. In this case, the second output transistor T8 may be turned on to output the first voltage Vgh applied to the input terminal of the second output transistor T8 as the first light emission control signal. When the fifth transistor T5 is turned on and the sixth transistor T6 is turned off (when a voltage of the first node q is a low level voltage), the first voltage Vgh of a high level voltage applied to the fifth transistor T5 may be applied to the gate electrode of the second output transistor T8. That is, the third node which is the gate electrode of the second output transistor T8 may be affected by the fifth transistor T5 constituting the first output terminal OUT1. Accordingly, the second light emission control signal EMib output from the second output terminal OUT2 is less affected by a variation of the voltage applied to the second node qb. That is, a ripple phenomenon in which noise occurs in the second light emission control signal EMib may be reduced.

A fourth capacitor Cob may be disposed between the gate electrode of the second output transistor T8 and the first voltage Vgh (or the input terminal of the second output transistor T8). As described above, the third capacitor Cqb may induce a bootstrap of the second node qb. Here, the third capacitor Cqb may raise the voltage of the second node qb to a voltage sufficient to turn on the second output transistor T8 due to coupling through parasitic capacitance between a gate and a drain of the sixth transistor T6. Further, the fourth capacitor Cob may serve to raise efficiency of the bootstrap of the third capacitor Cqb. That is, the fourth capacitor Cob may help to raise the voltage of the third node to a voltage capable of turning on the second output transistor T8 due to coupling between a gate and a drain of the second output transistor T8.

According to the aspect of the present disclosure, the first and second light emission control signals EMi and EMib are used as first and second start signals of a next stage, and thus a design of the light emission control driver 300 can be simplified so that an area occupied by the light emission control driver 300 can be reduced. Thus, in terms of implementing a narrow bezel, the light emission control driver 300 according to the aspect of the present disclosure can have an advantage.

According to the aspect of the present disclosure, the second light emission control signal EMib may be determined by the fifth transistor T5 and the sixth transistor T6, and a voltage signal applied to the gate electrode of the second output transistor T8 may be affected by the voltage of the first output terminal OUT1. Further, the first light emission control signal Emi may be determined by a voltage level of a signal output by the switching of the second output transistor T8 in addition to the switching of the first output transistor 17. That is, the first light emission control signal Emi is affected by the voltage of the second output terminal OUT2. Generally, when the second light emission control signal EMib is determined by only the voltage of the second node qb, noise occurring in the second light emission control signal EMib may be increased due to a variation of the voltage of the second node qb. On the other hand, even when the first light emission control signal Emi is determined only by the voltage of the first node q, noise occurring in the second light emission control signal EMib may be increased due to a variation of the voltage of the first node q. According to the aspect of the present disclosure, since an output of the second light emission control signal EMib may be determined by the fifth transistor T5 connected to the first node q in addition to the voltage of the second node qb, the second light emission control signal EMib may be less affected by the variation of the voltage of the first node q, so that voltage stability can be maintained and thus a ripple phenomenon can be reduced. Further, since the first light emission control signal Emi is affected by the voltage of the second node qb, influence of the variation of the voltage of the first node q may be less and thus the ripple phenomenon can be reduced.

Furthermore, a circuit which is less affected by the threshold voltages of the first transistor T1 and the second transistor T2 may be implemented by the third transistor T3 and the fourth transistor T4, to which the second clock signal CKb is applied, and the first capacitor Cb1 and the second capacitor Cb2 which are charged with the second clock signal CKb of a low level voltage, so that an operating margin of the light emission control driver 300 can be improved.

Figure 4:
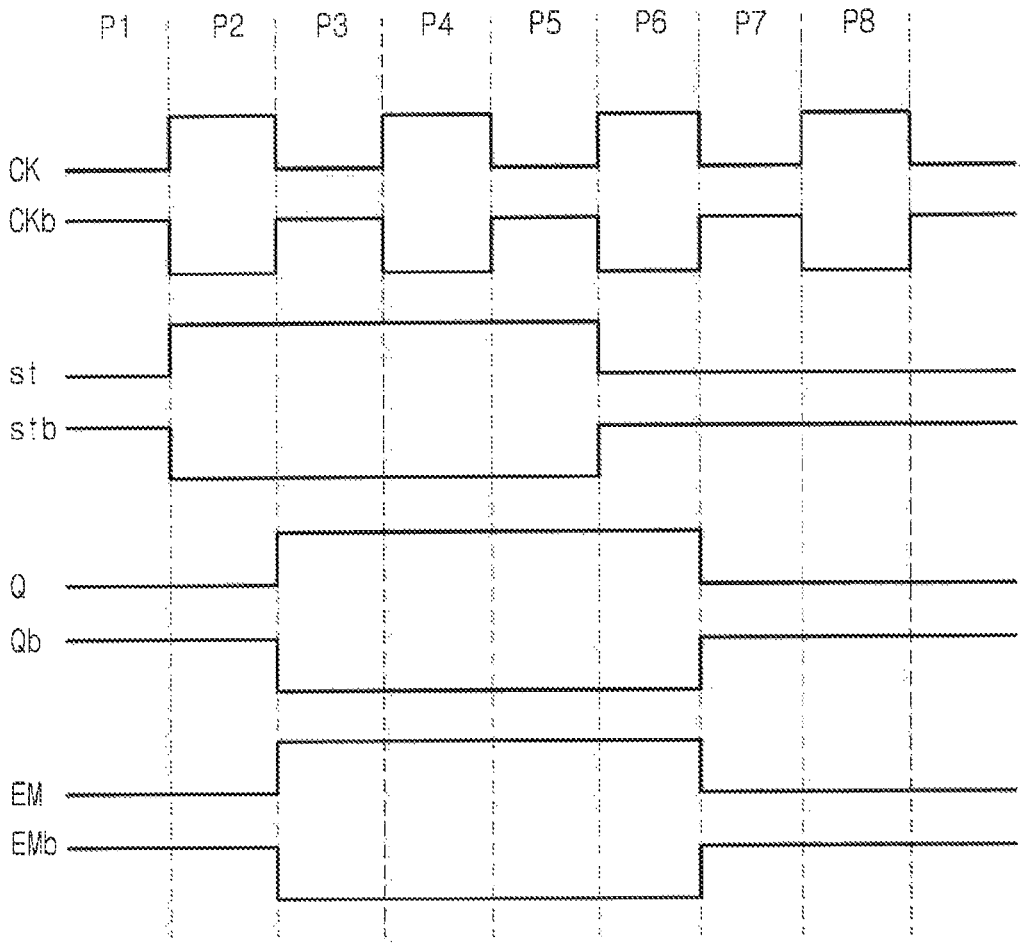
FIG. 4 is a timing chart for describing an operation of the stage of FIG. 3.

FIG. 4 is a timing chart for describing an operation of a stage of FIG. 3.

Referring to FIGS. 3 and 4, the first start signal st, the second start signal stb, the first clock signal CK, and the second clock signal CKb may be applied to one stage constituting the light emission control driver 300. The second start signal stb may be an inverted signal of the first start signal st, and the second clock signal CKb may be an inverted signal of the first clock signal CK.

During a first period P1, the first start signal st which is a light emission control signal of a previous stage may have a low level voltage. At this point, the second start signal stb which is a light emission control signal of the previous stage may have a high level voltage. As the first clock signal CK of a low level voltage is applied to the gate electrodes of the first transistor T1 and the second transistor T2, the first transistor T1 and the second transistor T2 may be turned on. Thus, a voltage of the first node q may be a low level voltage, and a voltage of the second node qb may be a high level voltage. Since the voltage of the first node q is the low level voltage, the fifth transistor T5 and the first output transistor T7 may be turned on, and a first light emission control signal EM output to the first output terminal OUT1 may have a low level voltage by the second voltage Vgl of a low level voltage applied to the first output transistor 17. Further, since the voltage of the second node qb is the high level voltage, the sixth transistor T6 and the second output transistor T8 may be turned on, and a second light emission control signal EMb output to the second output terminal OUT2 may have a high level voltage by the first voltage Vgh of a high level voltage applied to the fifth transistor T5.

During a second period P2, the first start signal st may have a high level voltage and the second start signal stb may have a low level voltage. As the first clock signal CK of a high level voltage is applied to the gate electrodes of the first transistor T1 and the second transistor T2, the first transistor T1 and the second transistor T2 may be turned off. At this point, the voltage of the first node q may be bootstrapped by a variation in voltage of the second clock signal CKb due to coupling of the fifth capacitor Cq, thereby being maintained as a low level voltage, and the voltage of the second node qb may be bootstrapped by a variation in voltage of the second clock signal CKb due to coupling of the third capacitor Cqb, thereby being maintained as a high level voltage. Since the voltage of the first node q is maintained at the low level voltage, the third transistor T3 may be turned on, and the first capacitor Cb1 may be charged with the low level voltage by the second clock signal CKb having the low level voltage applied to the third transistor T3. The voltage charged in the first capacitor Cb1 may drop a voltage level of the first node q below a low level. Therefore, a rise in voltage level of the first node q due to the threshold voltage of the first transistor T1 may be prevented, and thus the voltage of the first node q may be stabilized. As voltage levels of the first node q and the second node qb are maintained at the same voltage level during the first period P1, the first light emission control signal EM may have a low level voltage and the second light emission control signal EMb may have a high level voltage.

During a third period P3, the first start signal st may have a high level voltage and the second start signal stb may have a low level voltage. As the first clock signal CK of a low level voltage is applied to the gate electrodes of the first transistor T1 and the second transistor T2, the first transistor T1 and the second transistor T2 may be turned on. Thus, a voltage of the first node q may be a high level voltage, and a voltage of the second node qb may be a high level voltage. Since the voltage of the first node q is the high level voltage, the fifth transistor T5 and the first output transistor 17 may be turned off, and since the voltage of the second node qb is the low level voltage, the sixth transistor T6 and the second output transistor T8 may be turned on. The voltage of the third node may be a low level voltage by the second voltage Vgl which is the low level voltage applied to the sixth transistor T6. Therefore, the second light emission control signal EMb may have the low level voltage, and the first light emission control signal EM may have the high level voltage by the first voltage Vgh which is the high level voltage applied to the second output transistor T8.

During a fourth period P4, the first start signal st may be maintained as the high level voltage and the second start signal stb may be maintained as the low level voltage. The first transistor T1 and the second transistor T2 may be turned off by the first clock signal CK having a high level voltage. At this point, the voltage of the first node q may be maintained as the high level voltage by voltage boosting of the fifth capacitor Cq, and the voltage of the second node qb may be maintained as the low level voltage by voltage boosting of the third capacitor Cqb. Since the voltage of the second node qb is maintained at the low level voltage, the fourth transistor T4 may be turned on, and the second capacitor Cb2 may be charged with the low level voltage by the second clock signal CKb having the low level voltage applied to the fourth transistor T4. The voltage charged in the second capacitor Cb2 may drop a voltage level of the second node qb below the low level. Therefore, a rise in voltage level of the second node qb due to the threshold voltage of the second transistor T2 may be prevented, and thus the voltage of the second node qb may be stabilized. As the voltage levels of the first node q and the second node qb are maintained at the same voltage level as during the third period P3, the first light emission control signal EM may have a high level voltage and the second light emission control signal EMb may have a low level voltage.

During a fifth period P5, the first start signal st may have a high level voltage and the second start signal stb may have a low level voltage. As the first clock signal CK of a low level voltage is applied to the gate electrodes of the first transistor T1 and the second transistor T2, the first transistor T1 and the second transistor T2 may be turned on. At this point, the voltage of the first node q may be maintained as the low level voltage, and the voltage of the second node qb may be maintained as the high level voltage. Therefore, similar to during the fourth period P4, the first light emission control signal EM may have the high level voltage and the second light emission control signal EMb may have the low level voltage.

During a sixth period P6, the first start signal st may have a high level voltage and the second start signal stb may have a low level voltage. As the first clock signal CK of a high level voltage is applied to the gate electrodes of the first transistor T1 and the second transistor T2, the first transistor T1 and the second transistor T2 may be turned off. Therefore, the voltage of the first node q may be maintained as the high level voltage, the voltage of the second node qb may be maintained as the low level voltage, and similar to during the fifth period P5, the first light emission control signal EM may have the high level voltage and the second light emission control signal EMb may have the low level voltage.

During a seventh period P7, the first start signal st may have a low level voltage and the second start signal stb may have a high level voltage. As the first clock signal CK of a low level voltage is applied to the gate electrodes of the first transistor T1 and the second transistor T2, the first transistor T1 and the second transistor T2 may be turned on. At this point, the voltage of the first node q may have a low level voltage by the first start signal st, and the voltage of the second node qb may have a high level voltage by the second start signal stb. Since the voltage of the first node q is the low level voltage, the fifth transistor T5 and the first output transistor T7 may be turned on, and the first light emission control signal EM output to the first output terminal OUT1 may have the low level voltage by the second voltage Vgl applied to the first output transistor 17. Further, since the voltage of the second node qb is the high level voltage, the sixth transistor T6 and the second output transistor T8 may be turned on, and the second light emission control signal EMb output to the second output terminal OUT2 may have the high level voltage by the first voltage Vgh applied to the fifth transistor T5.

During an eighth period P8, the first start signal st may have a low level voltage and the second start signal stb may have a high level voltage. As the first clock signal CK of a high level voltage is applied to the gate electrodes of the first transistor T1 and the second transistor T2, the first transistor T1 and the second transistor T2 may be turned off. Therefore, the voltage of the first node q may be maintained as the low level voltage, and the voltage of the second node qb may be maintained as the high level voltage. Accordingly, similar during the seventh period P7, the first light emission control signal EM may have the low level voltage and the second light emission control signal EMb may have the high level voltage.

According to the aspect of the present disclosure, it can be seen that the second light emission control signal EMb is generated as an inverted signal of the first light emission control signal EM. Therefore, the first light emission control signal EM and the second light emission control signal EMb may be respectively used as a first start signal st and a second start signal stb of a next stage. Further, since the first voltage Vgh, which is the high level voltage applied to the fifth transistor T5 of the first output terminal OUT1, is used as a gate signal of the second output transistor T8, it is possible to reduce a ripple phenomenon which may occur in the second light emitting control signal EMib according to a variation in voltage of the second node qb.

Figure 5:
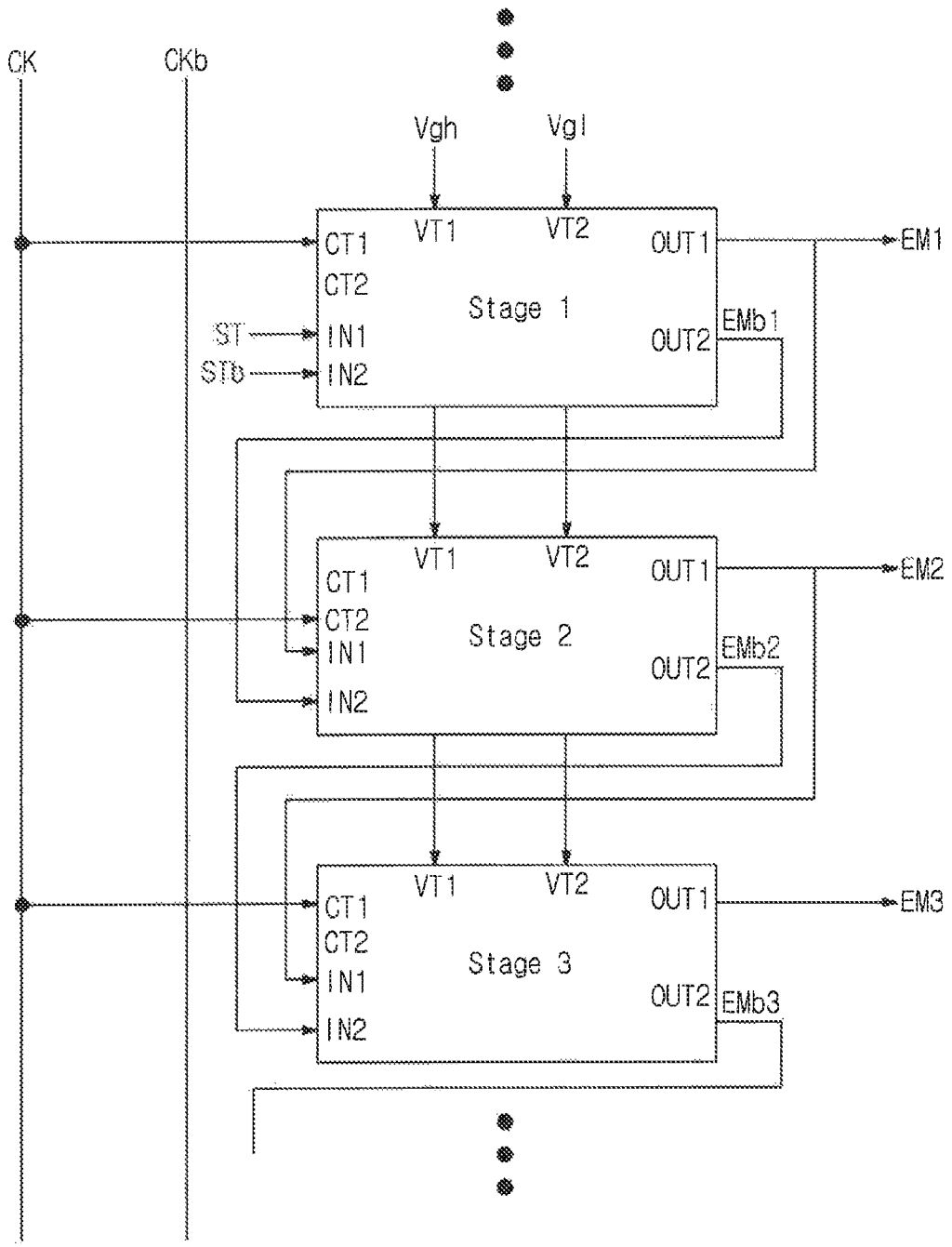
FIG. 5 is a block diagram of a light emission control driver according to another aspect of the present disclosure.

FIG. 5 is a block diagram of a light emission control driver according to another aspect of the present disclosure. For simplicity of description, an overlapping description will be omitted.

Referring to FIGS. 1 and 5, a light emission control driver 300 may include a plurality of stages, that is, Stage 1, Stage 2, and Stage 3. Each of Stage 1, Stage 2, and Stage 3 may output a light emission control signal. Each of Stage 1, Stage 2, and Stage 3 may include a first input terminal IN1, a second input terminal IN2, a first clock terminal CT1, a second clock terminal CT2, a first voltage terminal VT1, a second voltage terminal VT2, a first output terminal OUT1, and a second output terminal OUT2.

A first clock signal CK or a second clock signal CKb, which have different timings, may be applied to the first clock terminal CT1 and the second clock terminal CT2 of each of Stage 1, Stage 2, and Stage 3. The clock signals applied to adjacent stages may be different from each other. For example, the first clock signal CK may be applied to the first clock terminal CT1 of an odd-numbered stage (e.g., Stage 1) as a clock signal, and the second clock signal CKb may be applied to the second clock terminal CT2 of an even-numbered stage (e.g., Stage 2) as a clock signal. That is, unlike the aspect of the present disclosure described in FIG. 2, a single clock signal may be applied to each of Stage 1, Stage 2, and Stage 3. However, similar to the aspect described in FIG. 2, first and second emission control signals (e.g., EM1 and EMb1) may be first and second start signals st and stb of a next stage. A circuit is driven by applying only a single clock signal to a single stage, so that a circuit structure and a wiring structure may be simplified when compared with those of the aspect described in FIG. 2.

Figure 6:
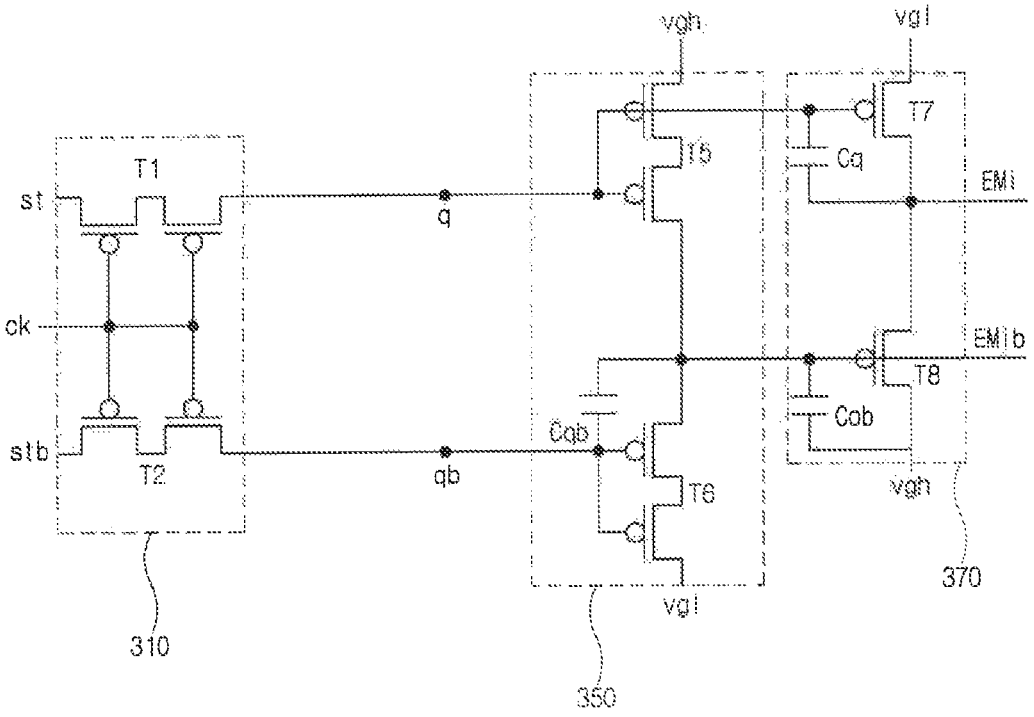
FIG. 6 is a circuit diagram of one stage of the light emission control driver according to another aspect of the present disclosure.

FIG. 6 is a circuit diagram of one stage of the light emission control driver according to another aspect of the present disclosure. For simplicity of description, an overlapping description will be omitted.

Referring to FIGS. 5 and 6, stages constituting the light emission control driver 300 may include a first circuit part 310, a second circuit part 350, and an output part 370. Transistors constituting each of the first circuit part 310, the second circuit part 350, and the output part 370 may be PMOS transistors, but the present disclosure is not limited thereto.

The first circuit part 310 may control a first node q and a second node qb in response to the first start signal st, the second start signal stb, and the first clock signal CK. The first circuit part 310 may include a first transistor T1 configured to apply the first start signal st to the first node q by being switched by the first clock signal CK, and a second transistor T2 configured to apply the second start signal stb to the second node qb by being switched by the first clock signal CK. That is, the first clock signal CK may be applied to a gate electrode of each of the first transistor T1 and the second transistor T2.

The second circuit part 350 may generate the second light emission control signal EMib in response to the first control signal of the first node q and the second control signal of the second node qb. The second circuit part 350 may include a third transistor T5 configured to be switched by the first control signal applied to the first node q, and a fourth transistor T6 configured to be switched by the second control signal applied to the second node qb.

A gate electrode of the third transistor T5 may be connected to the first node q, a first voltage Vgh may be applied to an input terminal of the third transistor T5, and an output terminal of the third transistor T5 may be connected to an output terminal of the fourth transistor T6. The first control signal applied to the first node q may be applied to the gate electrode of the third transistor T5.

A gate electrode of the fourth transistor T6 may be connected to the second node qb, a second voltage Vgl may be applied to an input terminal of the fourth transistor T6, and the output terminal of the fourth transistor T6 may be connected to the output terminal of the third transistor T5.

A position at which the third transistor T5 and the fourth transistor T6 are connected may be a third node. A first capacitor Cqb for boosting the second control signal applied to the second node qb may be disposed between the third node and the second node qb.

The output part 370 may include a first output transistor T7 configured to receive the first control signal from the first node q, and a second output transistor T8 configured to receive the second light emission control signal EMib output from the second circuit part 350.

A gate electrode of the first output transistor T7 may be connected to the first node q. The second voltage Vgl may be applied to an input terminal of the first output transistor T7, and an output terminal of the first output transistor 17 may be connected to an output terminal of the second output transistor T8. A position at which the output terminal of the first output transistor T7 and the output terminal of the second output transistor T8 are connected may be the first output terminal OUT1. The first output transistor T7 may output the second voltage Vgl as the first light emission control signal EMi through the first output terminal OUT1 in response to the first control signal. A second capacitor Cq may be disposed between the gate electrode of the first output transistor T7 and the first output terminal OUT1.

A gate electrode of the second output transistor T8 may be connected to the third capacitor Cob, and the third capacitor Cob may be connected to the second node qb. The first voltage Vgh may be applied to an input terminal of the second output transistor T8, and the output terminal of the second output transistor T8 may be connected to the output terminal of the first output transistor T7 and the first output terminal OUT1. When a voltage of the second node qb is a low level voltage, the fourth transistor T6 may be turned on and thus the second voltage Vgl may be applied to the gate electrode of the second output transistor T8. At this point, the second output transistor T8 may be turned on to output the first voltage Vgh as the first light emission control signal EMi.

The second light emission control signal EMib may be generated by the third transistor T5 affected by the voltage of the first node q and the fourth transistor T6 affected by the voltage of the second node qb. When the voltage of the first node q is a low level voltage, the second output transistor T8 may use the first voltage Vgh output by the third transistor T5 as a gate signal. Therefore, the second output transistor T8 may be affected by the voltage of the first node q in addition to the voltage of the second node qb, and the first light emission control signal Emi and the second light emission control signal EMib may be affected by both the voltage of the first node q and the voltage of the second node qb. Therefore, the light emission control signal that is an output signal may be less affected by a variation in voltage of the second node qb. That is, a ripple phenomenon in which noise occurs in the first light emission control signal Emi and the second light emission control signal EMib may be reduced.

Unlike the aspect of FIG. 2, the aspect of FIG. 6 relates to a circuit for generating two light emission control signals using only a single clock signal (e.g., the first clock signal CK). According to the aspect of FIG. 6, it is possible to implement a circuit capable of generating the two light emission control signals EMi and EMib using only six transistors and three capacitors and preventing a ripple phenomenon occurring in the second light emission control signal EMib. Further, the two emission control signals EMi and EMib output the same as in the aspect of FIG. 2 may be used as start signals of a next stage. Accordingly, the aspect of FIG. 6 may further simplify a design of the light emission control driver 300 compared with the aspect of FIG. 2, and thus it may be advantageous in terms of implementing a narrow bezel.

In accordance with the aspects of the present disclosure, first and second light emission control signals of one stage are used as first and second start signals of a next stage, and thus a design of a light emission control driver can be simplified so that an area occupied by the light emission control driver can be reduced.

In accordance with the aspects of the present disclosure, a voltage signal applied to a gate electrode of a second output transistor is affected by a voltage applied to a first output terminal, so that a ripple phenomenon due to a variation in voltage of a second node can be reduced.

In accordance with the aspects of the present disclosure, it is possible to implement a circuit capable of resolving instability of a voltage due to threshold voltages of transistors to which start signals are applied, so that an operating margin of the light emission control driver can be improved.

While the aspects of the present disclosure have been described with reference to the accompanying drawings, a person skilled in the art to which the present disclosure pertains may understand that the present disclosure can be implemented in other specific form without departing from the technical spirit and essential features of the present disclosure. Therefore, it should be understood that the above-described aspects are not restrictive but illustrative in all aspects.

What is claimed is:

1. A light emission control driver, comprising:
a plurality of stages,
wherein each of the plurality of stages includes:
a first circuit part receiving a first start signal and a second start signal and controlling a first node and a second node in response to a first clock signal;
a third circuit part outputting a second light emission control signal in response to a first control signal supplied to the first node or a second control signal supplied to the second node; and
an output part outputting a first light emission control signal in response to the first control signal or the second light emission control signal.

2. The driver of claim 1, wherein the first light emission control signal and the second light emission control signal respectively become a first start signal and a second start signal of a next stage.

3. The driver of claim 1, wherein the first circuit part includes:
a first transistor to which the first start signal is applied; and
a second transistor to which the second start signal is applied,
wherein the first clock signal is applied to a gate electrode of the first transistor and a gate electrode of the second transistor.

4. The driver of claim 1, further comprising a second circuit part receiving a second clock signal and switched by the first control signal and the second control signal to stabilize signals at the first node and the second node.

5. The driver of claim 4, wherein the second circuit part includes:

a third transistor including a gate electrode connected to the first node, an input terminal for receiving the second clock signal, and an output terminal connected to a first capacitor; and a fourth transistor including a gate electrode connected to the second node, an input terminal for receiving the second clock signal, and an output terminal connected to a second capacitor, wherein the first capacitor is disposed between the first node and the output terminal of the third transistor, and the second capacitor is disposed between the second node and the output terminal of the fourth transistor.

6. The driver of claim 1, wherein the third circuit part includes:

a fifth transistor switched in accordance with the first control signal applied to the first node; and a sixth transistor switched in accordance with the second control signal applied to the second node, wherein a first voltage is applied to an input terminal of the fifth transistor and a second voltage is applied to an input terminal of the sixth transistor.

7. The driver of claim 6, wherein the fifth transistor is turned on to output the first voltage as the second light emission control signal when a voltage of the first node is a low level voltage.

8. The driver of claim 6, wherein the sixth transistor is turned on to output the second voltage as the second light emission control signal when a voltage of the second node is a low level voltage.

9. The driver of claim 7, wherein the second light emission control signal is a signal applied to a third node at which the output terminal of the fifth transistor and the output terminal of the sixth transistor are connected to each other.

10. The driver of claim 9, further comprising a third capacitor for boosting a voltage of the second node disposed between a third node and the second node.

11. The driver of claim 1, wherein the output part includes:

a first output transistor outputting a second voltage as the first light emission control signal in response to the first control signal; and a second output transistor outputting a first voltage as the first light emission control signal in response to the second light emission control signal, wherein an output terminal of the first output transistor and an output terminal of the second output transistor are connected at a first output terminal from which the first light emission control signal is output.

12. The driver of claim 11, wherein the second light emission control signal is applied to a gate electrode of the second output transistor to control a switching of the second output transistor.

13. The driver of claim 11, wherein the first output transistor is turned on to output the second voltage as the first light emission control signal when a voltage of the first node is a low level voltage.

14. The driver of claim 11, wherein the second output transistor is turned on to output the first voltage as the first light emission control signal when a voltage of the first node is a high level voltage and a voltage of the second node is a low level voltage.

15. The driver of claim 11, further comprising a fourth capacitor for boosting the voltage of the second node disposed between a gate terminal of the second output transistor and an input terminal thereof.

16. The driver of claim 11, further comprising a fifth capacitor for boosting the voltage of the first node disposed between the first output terminal and a gate electrode of the first output transistor.

17. The driver of claim 1, wherein the first clock signal applied to a one stage of the plurality of stages is an inverted signal of a first clock signal applied to a next stage of the one stage.

18. A light emission control driver including a plurality of stages, each stage comprising:

a first circuit part receiving a first start signal and a second start signal and controlling a first node and a second node in response to a first clock signal;

a second circuit part receiving a second clock signal and switched by the first control signal and the second control signal to stabilize signals at the first node and the second node;

a third circuit part outputting a second light emission control signal in response to a first control signal supplied to the first node or a second control signal supplied to the second node; and an output part outputting a first light emission control signal in response to the first control signal or the second light emission control signal, wherein the first light emission control signal and the second light emission control signal respectively become a first start signal and a second start signal of a next stage.

19. The driver of claim 18, wherein the first clock signal applied to a one stage of the plurality of stages is an inverted signal of a first clock signal applied to a next stage of the one stage.

* * * * *